US008240365B2

(12) United States Patent
Obana et al.

(10) Patent No.: US 8,240,365 B2
(45) Date of Patent: Aug. 14, 2012

(54) HEAT EXCHANGER

(75) Inventors: Mitsuru Obana, Derby (GB); Andrew M Rolt, Derby (GB)

(73) Assignee: Rolls-Royce plc, London (GB)

( * ) Notice: Subject to any disclaimer, the term of this patent is extended or adjusted under 35 U.S.C. 154(b) by 1508 days.

(21) Appl. No.: 11/725,511

(22) Filed: Mar. 20, 2007

(65) Prior Publication Data

US 2011/0180245 A1 Jul. 28, 2011

(30) Foreign Application Priority Data

Mar. 23, 2006 (GB) ..... 0605802.8

(51) Int. Cl.
*F28F 9/26* (2006.01)
*F28D 1/00* (2006.01)

(52) U.S. Cl. ..... 165/144; 165/150

(58) Field of Classification Search ..... 165/162, 165/113, 144, 145, 150
See application file for complete search history.

(56) References Cited

U.S. PATENT DOCUMENTS

| | | | | | |
|---|---|---|---|---|---|
| 376,390 | A | | 1/1888 | Morrison | |
| 711,769 | A | * | 10/1902 | Hussey | 165/175 |
| 977,538 | A | * | 12/1910 | Odenkirk | 122/356 |
| 1,024,554 | A | | 4/1912 | Carter | |
| 2,198,529 | A | * | 4/1940 | Fields | 165/82 |
| 3,153,446 | A | * | 10/1964 | Shaw | 165/164 |
| 3,180,406 | A | * | 4/1965 | Oechslin | 165/144 |
| 3,483,920 | A | | 12/1969 | Heyn | |
| 3,866,674 | A | | 2/1975 | Tramuta | |
| 4,014,385 | A | | 3/1977 | Wright | |
| 4,063,589 | A | * | 12/1977 | Battcock | 165/104.16 |
| 4,417,619 | A | * | 11/1983 | Minami | 165/113 |
| 4,475,587 | A | | 10/1984 | Vasiliev | |
| 5,318,180 | A | | 6/1994 | Grigsby | |
| 6,167,954 | B1 | * | 1/2001 | Martins | 165/175 |
| 6,877,552 | B1 | * | 4/2005 | King | 165/163 |
| 2005/0006064 | A1 | | 1/2005 | Garimella | |

FOREIGN PATENT DOCUMENTS

| | | |
|---|---|---|
| DE | 3612770 | 10/1987 |
| DE | 10056229 | 6/2002 |
| JP | 1169295 | 7/1989 |
| JP | 2000329485 | 11/2000 |
| SU | 756173 | 8/1980 |

* cited by examiner

*Primary Examiner* — Tho V Duong
(74) *Attorney, Agent, or Firm* — Jeffrey S. Melcher; Manelli Selter PLLC

(57) ABSTRACT

It is known that corrugated plate heat exchangers can have good thermal and hydraulic performance but limitations with regard to operational pressures whilst conventional tube type heat exchangers can achieve high pressure operation but can have high flow pressure losses due to the configuration of such tubes. By arranging a tube stack comprising respective tubes 2*a*, 3*a* arranged in layers typically one upon the other with cross junctions 4 between them and intersticial gaps between tubes it is possible to create swirling spinning motion in the flow possibly inside and at least outside the tubes for improved heat exchange with only limited flow restriction. The swirling flow in the heat exchanger matrix outside of the tubes passes along channels formed by the interconnecting intersticial gaps between the tubes and is guided about those tubes for heat exchange. Typically, a multitude of stack layers is combined such that association between the stack layers prevents in operation lateral and vertical movements as well as vibration of the tubes.

25 Claims, 6 Drawing Sheets

HEAT EXCHANGER

CROSS-REFERENCE TO RELATED APPLICATIONS

This application claims foreign priority to GB 0605802.8, filed 23 Mar. 2006.

BACKGROUND OF THE INVENTION

The present invention relates to heat exchangers and more particularly to heat exchangers utilised in gas turbine engines.

Heat exchange is important in order to ensure machinery and engines such as gas turbine engines remain within acceptable operational parameters for the materials from which that machinery or engine is formed as well as to achieve efficient thermodynamic operation. Generally heat exchange is performed between two fluid streams. Fluids may be liquids or gasses or combinations of the two, and phase change may also occur within a heat exchanger. The most efficient heat exchangers ensure that there is good heat transfer and low pressure loss in the fluids by optimising flow rates, and the available surface areas for heat exchange.

There are a number of prior basic types of heat exchanger including for example plate and fin type heat exchangers as shown in U.S. Pat. No. 3,866,674, cross-corrugated plate heat exchangers as shown in U.S. Pat. No. 4,014,385, tubular heat exchangers as shown in U.S. Pat. No. 5,318,180 and a refined tubular heat exchanger as described in Japanese Patent JP 2000329485. Each of these heat exchanger designs has limitations with regard to thermal performance or acceptability for different operational environments in terms of pressure capability both absolutely and in terms of pressure loss in the coolant flows themselves as well as such matters as ease of fabrication with suitable materials. Generally compromises must be made with regard to heat exchanger effectiveness in view of the above considerations as well as weight and design performance objectives.

SUMMARY OF THE INVENTION

According to the present invention there is provided a heat exchanger comprising a lattice formed from a plurality of tubes, the tubes in the lattice are divided into at least two tube groups, the tubes in at least one tube group are arranged at a crossing angle to the tubes in at least one other tube group and the tube groups are stacked in a stack layer with a junction between a respective tube in at least one tube group and a respective tube in at least one other tube group, the lattice having interconnecting interstices between the tubes to enable heat exchange between a fluid or fluids inside the tubes and another fluid outside the tubes.

Generally, the tubes are circular in cross section. Generally, the interstices define channels between adjacent tubes the channels are obstructed by an obstruction portion of a tube. Typically, the obstruction portion of a tube is the junction between tubes. Typically, the obstruction portion of a tube guides fluid flow. Typically, the obstruction portion of a tube guides fluid flow between the stack layers of tubes in respective tube groups.

Normally, the crossing angle between the tube groups within a stack layer and the crossing angle between tube groups in adjacent stack layers is in the range 30° to 60°.

Alternatively, the crossing angle between the tube groups within a stack layer and the crossing angle between tube groups in adjacent stack layers is in the range 60° to 120°.

Possibly, tubes in the at least two tube groups within the stack layers are arranged to contact each other to restrain relative movement of the tubes. Possibly, the tubes in adjacent stack layers are arranged to contact each other to restrain vibration of the tubes.

Normally, the junctions between tubes may be crossing junctions of the tubes. Alternatively, the junctions between tubes may be end junctions of the tubes.

Possibly, the tubes are joined together at some or all of the junctions and possibly the junctions include interconnecting holes between the tubes. Such holes may be formed by welding about the periphery junction of intersecting tubes. Two tube groups with interconnecting junctions could be formed as an integral part by electro-deposition.

Possibly, the tubes have a surface treatment to facilitate heat exchange. Possibly, the surface treatment is divided or spiralled or both. Possibly, there is an internal surface treatment and an external surface treatment with respect to the tube surfaces.

Normally, the tubes and tube groups and stack layers are secured together by inlet and outlet manifold connections. Adjacent tube groups within a stack layer may also be joined together by edge connectors at the sides of the stack layers. Possibly, the edge connectors comprise loops to facilitate low flow resistance.

Possibly, all stack layers are identical repeating elements.

Possibly, adjacent stack layers are substantially mirror images about an interface plane between adjacent stack layers.

Possibly the heat exchanger is provided as a gas turbine heat exchanger. Possibly, the gas turbine heat exchanger is a recuperator, an oil cooler, a turbine coolant cooler or a liquid to liquid heat exchanger.

Also in accordance with the present invention there is provided a heat exchanger system comprising a plurality of heat exchangers as described above. Generally, the heat exchanger system will be arranged such that the plurality of heat exchangers is connected together to form a cluster for higher fluid flow rate capacity.

BRIEF DESCRIPTION OF THE DRAWINGS

Embodiments of aspects of the present invention will now be described by way of example only and with reference to the accompanying drawings in which:—

DETAILED DESCRIPTION OF THE INVENTION

Heat exchangers are generally a compromise between acceptable heat exchanger effectiveness and other desirable operational capabilities on the one hand, and cost and weight, which are a function of the available materials and manufacturing technologies, on the other hand. Heat exchangers generally are arranged to exchange heat between two fluid flows in respective parts of the heat exchanger. Previous heat exchangers have incorporated, as outlined above, fins and other elements in order to increase or maximise heat transfer surface areas for greater heat exchange within a given space envelope. Such fins and structures can significantly add to heat exchanger weight as well as manufacturing complexities. It will also be understood that reducing any restrictions and restraints upon fluid flow can seriously affect heat exchanger effectiveness and hydraulic performance.

Aspects of the present invention comprise creating a heat exchanger comprising a lattice formed from a plurality of tubes. The tubes are arranged in a stack layer normally formed by two groups of tubes. A heat exchanger will normally contain multiple stack layers.

Figure 1:
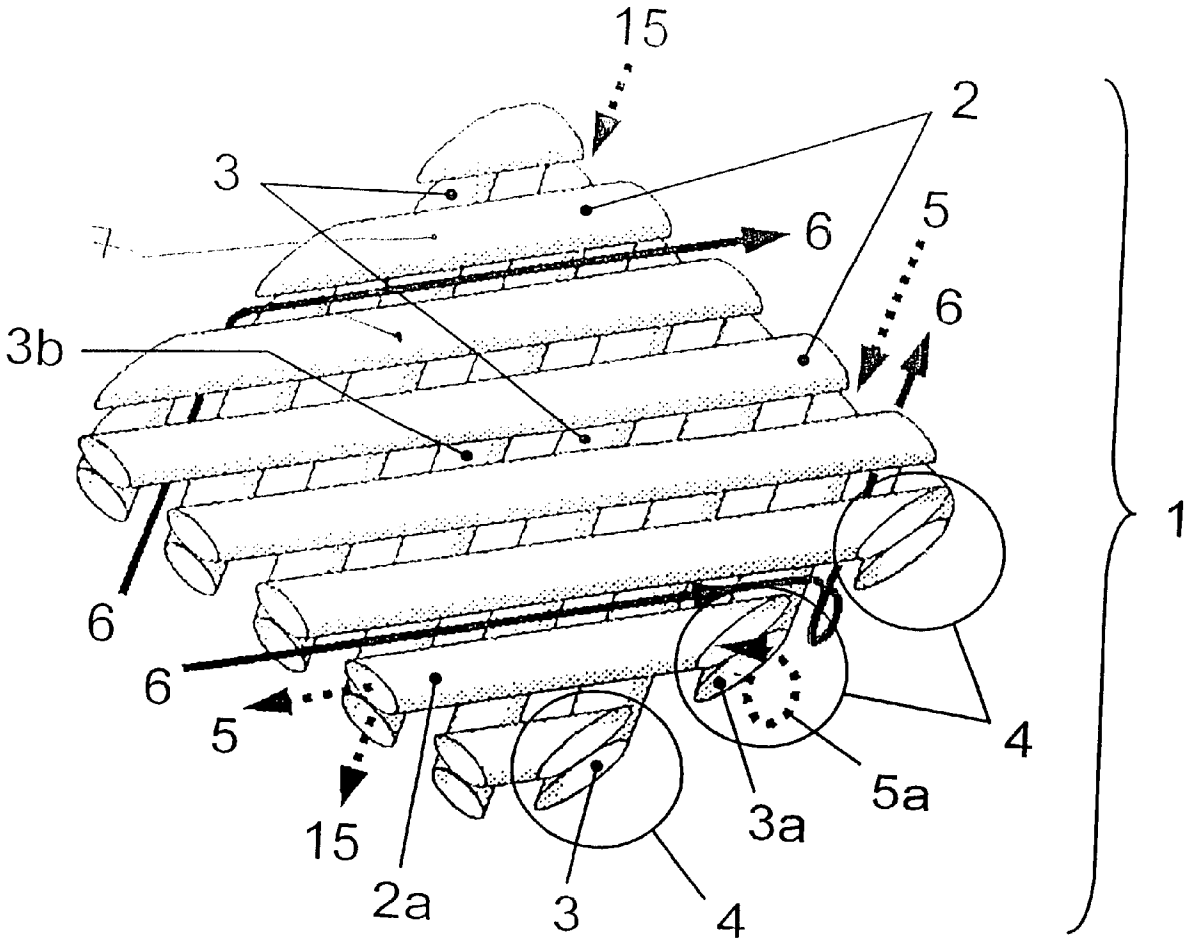
FIG. 1 is a schematic perspective view of a portion of a heat exchanger in accordance with aspects of the present invention.

FIG. 1 provides a schematic front perspective view of a portion of a single stack layer 1 of a heat exchanger in accordance with the present invention. As can be seen the portion of the stack layer 1 comprises two groups of tubes 2, 3 arranged with the tubes at an angle relative to each other. It will be appreciated that the groups 2, 3 as depicted in FIG. 1 generally present one group 2 in a plane substantially parallel with the second tube group 3. Fluid connecting junctions 4 are provided so that a fluid flow 5 inside the tubes can pass from one tube group 2 or 3 to the other group 3 or 2 in paths typically depicted by arrow 5*a*.

It is possible that a fluid connecting junction 4 could be provided at each angular crossing of tubes 7 in the tube groups 2, 3 in each stack layer. However, such an arrangement is potentially difficult to manufacture. In such circumstances junctions 4 may only be provided at occasionally repeated positions within the heat exchanger structure with other tube cross overs not interconnected. In such circumstances as depicted fluid flow 5 as indicated may pass along a first tube 3*a* and then through the junction 4 into a second tube 2*a* or alternatively a fluid flow 15 may pass completely through a tube 3*b* without cross over.

In any event the flows 5, 15 are held within the tube groups 2, 3. These fluid flows 5, 15 will typically either comprise a fluid to be cooled or heated. In either event interstitial gaps between the tube groups 2, 3 will allow other fluid flows 6 to pass about the tubes in order to exchange heat through the walls of those tubes with fluid flows 5, 15 within the tubes. It will be understood that the size and repeat spacing of the interstices in the tube groups 2, 3 will be chosen in order to achieve a desired heat exchanger effectiveness and an acceptable pressure loss in each flow.

It will be understood that the junctions 4 between tube groups 2, 3 will generally act as flow obstructions within the interstitial space between the tube groups 2, 3. In such circumstances the fluid flows 6 as illustrated will generally encounter these junctions 4 as obstructions to such flows 6 which will then tend to divert the flows 6 and generate additional turbulence to enhance heat transfer at the expense of additional pressure loss.

In the above circumstances it will be understood that the performance characteristics of the heat exchanger matrix formed from multiple stack layers will be determined not only by its overall dimensions and inlet and outlet flow arrangements, but also by the dimensions of the tubes 2*a*, 3*a* and the size of the gaps between the tubes within a tube group 2, 3 and the size of the gaps between tube groups 2 and 3 and also by the crossing angle between the tubes in the respective tube groups both within a stack layer and between adjacent stack layers and also by the arrangement of the junctions.

It will be understood that by appropriate positioning of the junctions 4 and flow inlet and outlet arrangements cross flow or counter flow or parallel flow can be achieved in the overall flows within a heat exchanger formed in accordance with aspects of the present invention.

Heat exchangers in accordance with aspects of the present invention comprise an array of tubes such that one tube group 2 and the other tube group 3 cross at an angle as defined above. This angle may be any appropriate angle but will generally be in the range 30° to 60° for a parallel or counter flow design and in the range 60° to 120° for a cross flow design.

Having a circular cross section tube allows an inherent high pressure capability with regard to the fluid flows 5, 15 within the tubes 2*a*, 3*a*. Nevertheless, due to the obstruction effect of the junctions 4 and the relatively high heat transfer surface areas provided by the tubes, it will be understood that it is generally not necessary to provide fins to act as secondary heat transfer surfaces between the fluid flows 5, 15, 6 in a heat exchanger in accordance with aspects of the present invention. Removal of such fins will significantly reduce the cost and weight of the heat exchanger formed from heat exchanger portions as depicted in FIG. 1. It will also be understood that the primary heat transfer area is defined by the wall surface area of the tubes 2*a*, 3*a*. In such circumstances the heat transfer area per unit volume can be increased by using tubes which have a smaller diameter and packing more of such tubes into a smaller space envelope.

A heat exchanger in accordance with the present invention acts in a similar manner to a cross corrugated plate heat exchanger where the flow 6 outside the tubes flows without much impingement until it switches from one direction to another as a result of an obstruction created by the junction 4. This is a similar situation with respect to the cross-corrugations of a plate heat exchanger where intersecting flows induce a helical spiral motion that scrubs the boundary layer adjacent to a wall surface to give a higher heat transfer rate with relatively low flow resistance. However, the generally open nature of the cross corrugated plates means that such heat exchangers have a relatively low pressure capability even when fully brazed or welded due to the brazing or welding only occurring at localised contact points between the corrugations. The tubes 2*a*, 3*a* of a heat exchanger in accordance with aspects of the present invention ensure that high pressure flows 5, 15 can be securely contained in the tubes without the potential for plate distortion and buckling that is present in a typical cross-corrugated heat exchanger.

In terms of flow resistance it will be understood that a heat exchanger in accordance with aspects of the present invention will typically have relatively few bends, that is to say turns in flow length, as compared to a zigzag flow path with previous heat exchangers such as the tubular heat exchanger depicted in Japanese Patent Application No. JP2000-329485. Furthermore, each tube in accordance with the present invention will have its own tube inlet so that for a given frontal area there will be a larger number of inlets such that there is a lower mass flux per tube and hence lower flux resistance inside each tube.

In principle tube supports as required with some previous heat exchangers are no longer necessary as the tubes in respective stack layers are generally stacked one upon the other such that out of plane movement of the tubes is stopped by an adjacent tube in an adjacent tube group whilst in-plane vibration of the tubes is dampened by contact friction with the same tubes.

Figure 2:
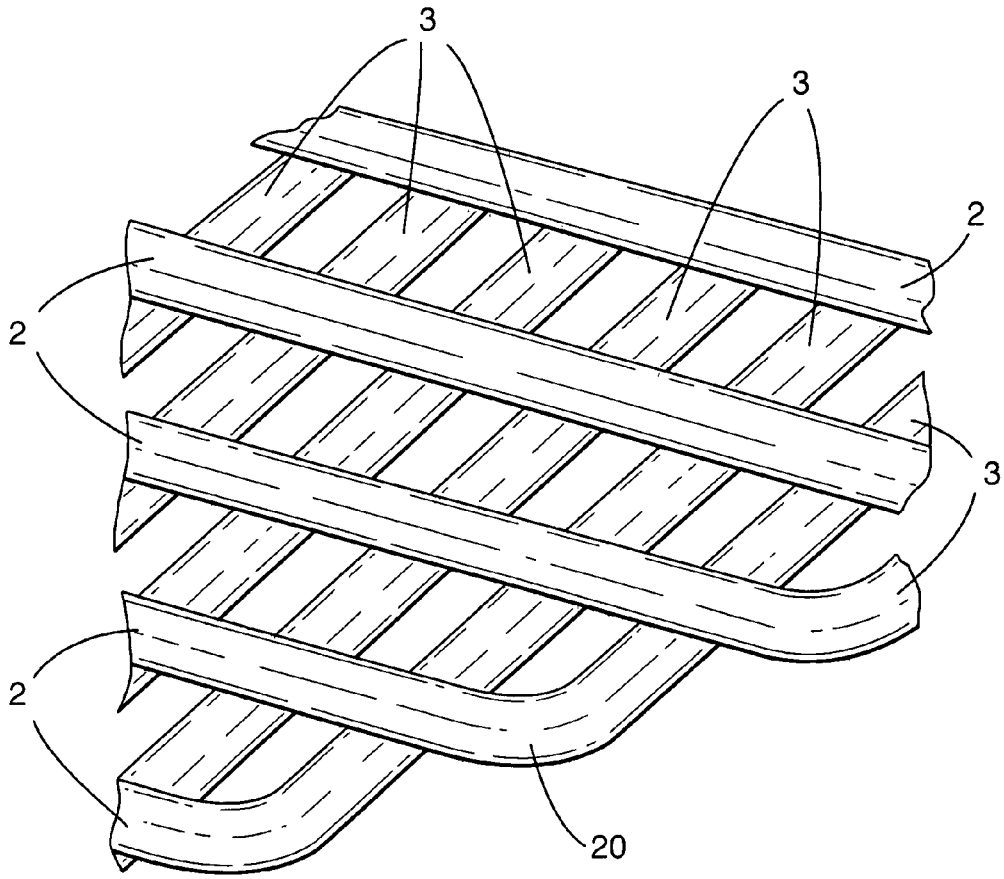
FIG. 2 is a schematic side view of a portion of a heat exchanger in accordance with aspects of the present invention viewed along an edge between stack layers.

FIG. 2 provides a schematic illustration of the tube groups 2, 3 depicted in FIG. 1 viewed along a side edge of the matrix. The tube groups 2, 3 are joined together by edge junctions 20 which may be additionally or alternative to the joins at cross junctions 7 depicted in FIG. 1. The edge junctions 20 are substantially curved or rounded to reduce flow resistance in the tubes.

Figure 3:
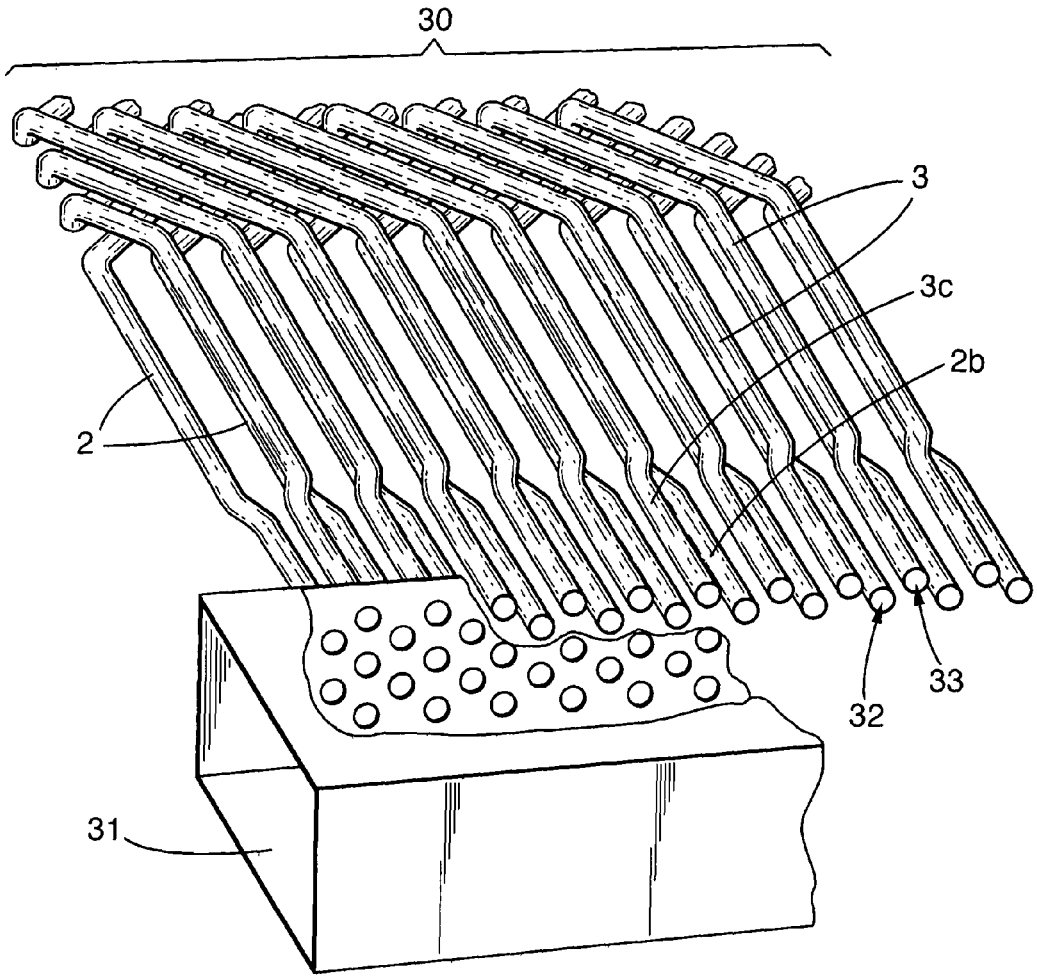
FIG. 3 is a schematic front perspective view of a portion of a heat exchanger in accordance with aspects of the present invention including connector ends.

FIG. 3 illustrates a tube entry front edge of a portion of a heat exchanger 30 comprising one stack layer of two tube groups 2, 3 as depicted in FIGS. 1 and 2 and arranged in order to create a heat transfer matrix of a parallel flow or counter flow heat exchanger in accordance with aspects of the present invention. The tubes 2*b*, 3*c* are connected to a portion of manifold 31 typically in the form of a rectangular or circular duct such that tube ends 32, 33 are presented to the manifold 31. Fluid will flow through the tubes 2*b*, 3*c* via the inlets 32, 33 and through the heat exchanger matrix 30 formed by the tubes in the heat exchanger 30 for heat exchange with external fluid flows about the tube groups 2, 3.

Figure 4:
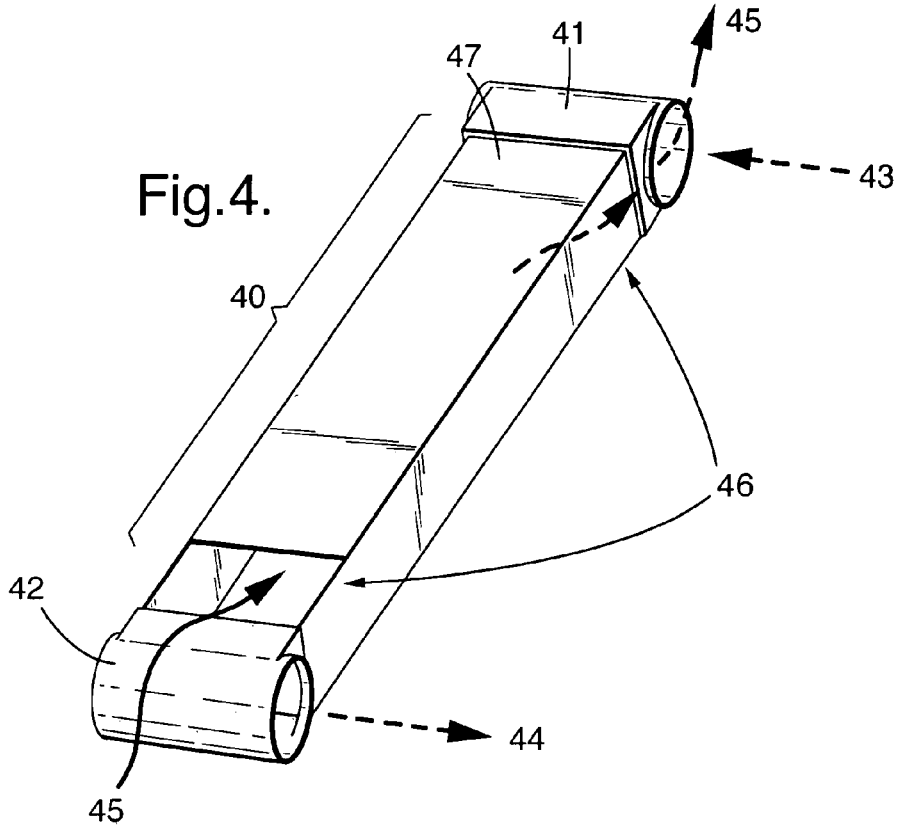
FIG. 4 is a schematic front perspective view of a heat exchanger including ducting and manifolds in accordance with aspects of the present invention.

FIG. 4 provides an example of the manifolds associated with a heat exchanger matrix in accordance with aspects of the present invention. Thus, the heat exchanger 40 has respective inlet and outlet manifolds 41, 42 through which respective fluid flows pass in the direction of arrow heads 43, 44 such that the fluid flows through the tube groups 2, 3 (FIGS. 1 and 2) in order to create heat exchange with a fluid flow passing in the direction of arrow heads 45 through apertures 46 in the outside envelope walls 47 of the heat exchanger 40. In such circumstances there is heat exchange between a first side which will generally be provided by the fluid flows through the manifolds 41, 42 and a second side of the heat exchanger 40 which will generally comprise of fluid flows in the direction of arrow head 45 across the heat exchanger 40.

By provision of a heat exchanger in accordance with aspects of the present invention which comprises multiple layers of stacks comprising tube groups as depicted in FIG. 1 it will be understood that an enhanced inherent higher pressure capacity is achieved for a given material thickness and weight whilst the heat exchanger has a relatively low weight with no necessity for secondary heat transfer devices such as fins. Furthermore heat transfer is achieved with relatively low flow resistance outside the tubes as well as within the tubes and in view of the nature of the construction of the tubes it may not be necessary to provide constraining tube supports to prevent tube movements as well as vibration in use. It will also be understood that cross flow and counter flow between the flows 5, 15 and flow 6 (FIG. 1) can be achieved through appropriate choice of manifold design.

Figure 5:
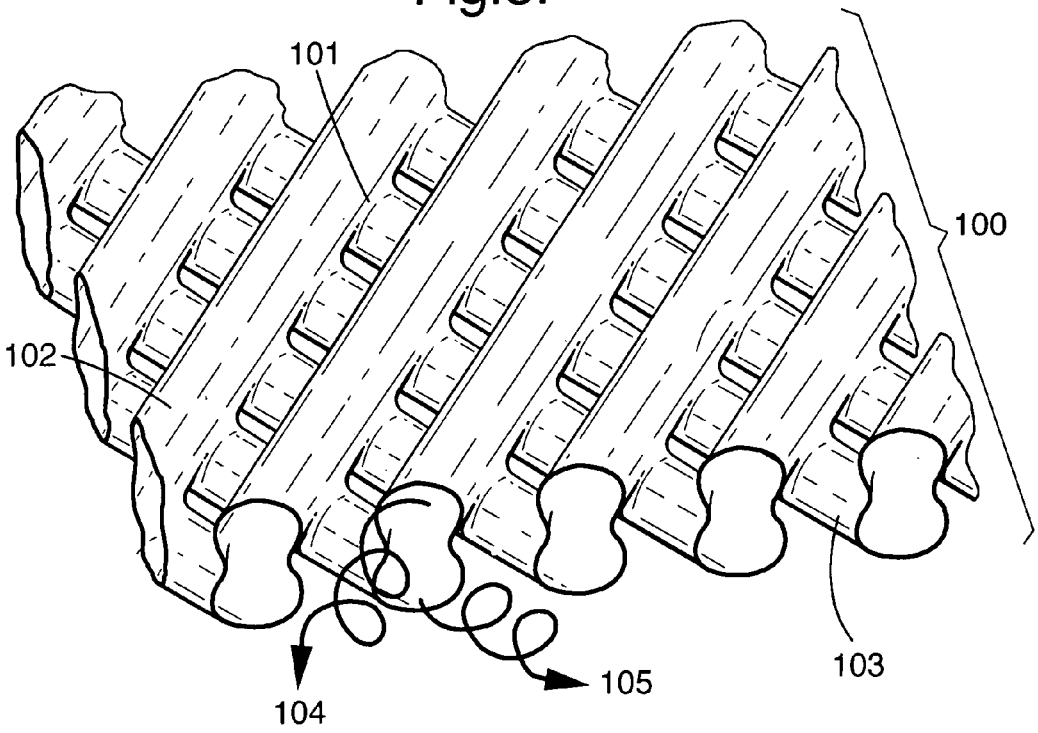
FIG. 5 is a schematic front perspective view of an alternative configuration of a heat exchanger in accordance with aspects of the present invention.

FIG. 5 provides a schematic illustration of an alternative arrangement of a heat exchanger in accordance with aspects of the present invention.

FIG. 5 only provides an illustration of a portion of a heat exchanger stack 100 which will be formed in a multiple stack arrangement as described previously. In this alternative, junctions 101 between crossing tubes 102, 103 are linked by interconnecting holes. Formation of these interconnecting holes may require relatively sophisticated manufacturing techniques such as electro deposition but by provision of interconnecting holes it will be appreciated that the configuration induces a spinning motion in the flows 104, 105 within the tubes which will again further improve heat transfer. Thus, the holes between the overlaid or intersecting tubes will have diameters chosen in order to create cross over between tubes 102, 103 and induce spinning motion in the flow without generating excessive pressure losses.

As indicated above heat exchange is a principal objective with regard to a heat exchanger. In such circumstances the lattice tubes in accordance with the present invention may have spiral fluting or have dimpled surfaces to further enhance heat exchange between the fluids within the tubes and the fluid flows external to the tubes. It will be appreciated that dimpled or fluted surfaces both internally within the tube and externally of the tube will increase surface boundary flow turbulence and therefore potentially heat exchange at the cost of some increase in flow resistance.

Figure 6:
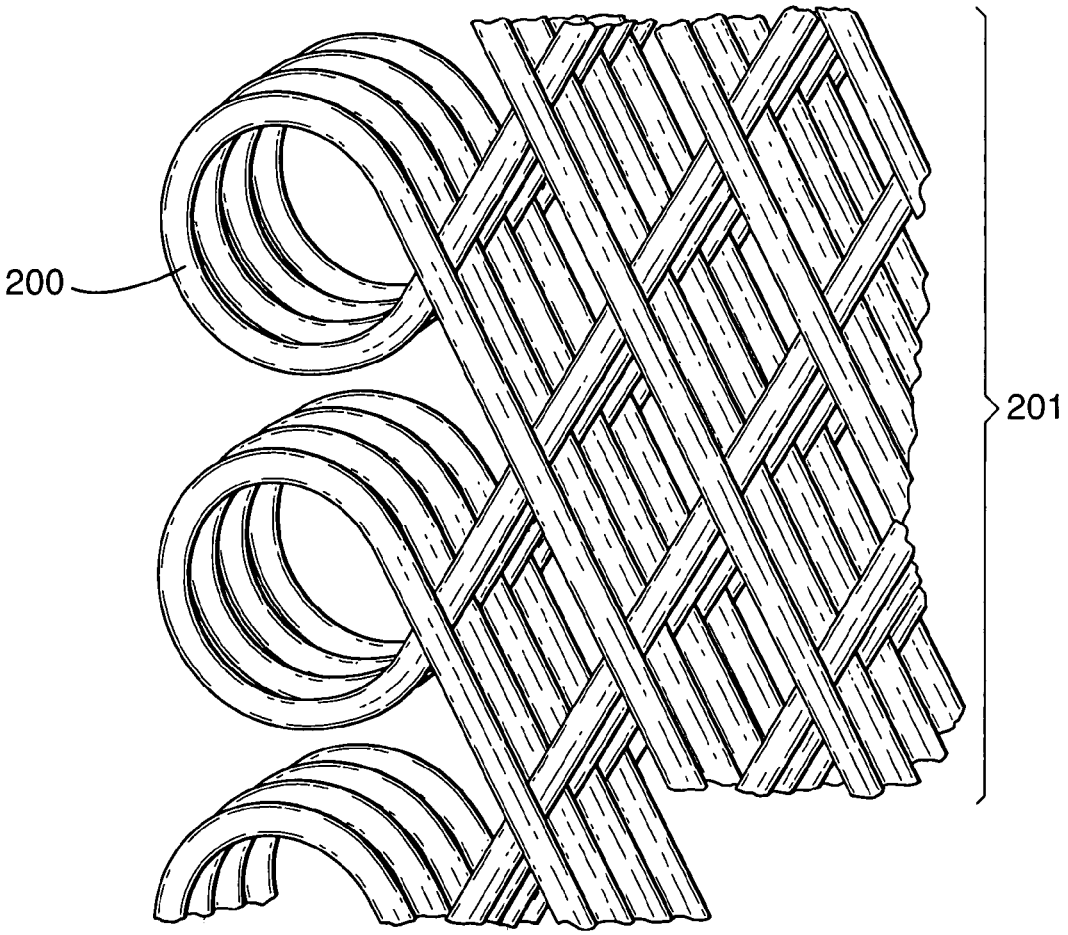
FIG. 6 is a schematic view of edge loops between tubes in stack layers of a heat exchanger in accordance with aspects of the present invention; and, FIG. 7 is a schematic view of a heat exchanger arrangement depicting a cluster of heat exchangers in accordance with aspects of the present invention.

As an alternative to the edge junction arrangement 20 shown in FIG. 2, FIG. 6 shows the edge portions 200 of the heat exchanger stacks 201 arranged to have loops between the respective tubes in each layer. Such looping can give more flexibility to the heat exchanger matrix, in terms of accommodating thermal expansion of the tubes. As can be seen these loops will generally be of a circular nature and extend beyond a peripheral cross over between tubes in respective stack layers.

In order to ensure that tubes in adjacent stack layers are parallel to each other it will be understood that stack layers in accordance with certain aspects of the present invention may be arranged so that within a heat transfer matrix adjacent stack layers are either identical or stack layers are arranged alternately as mirror images of each other.

Figure 7:
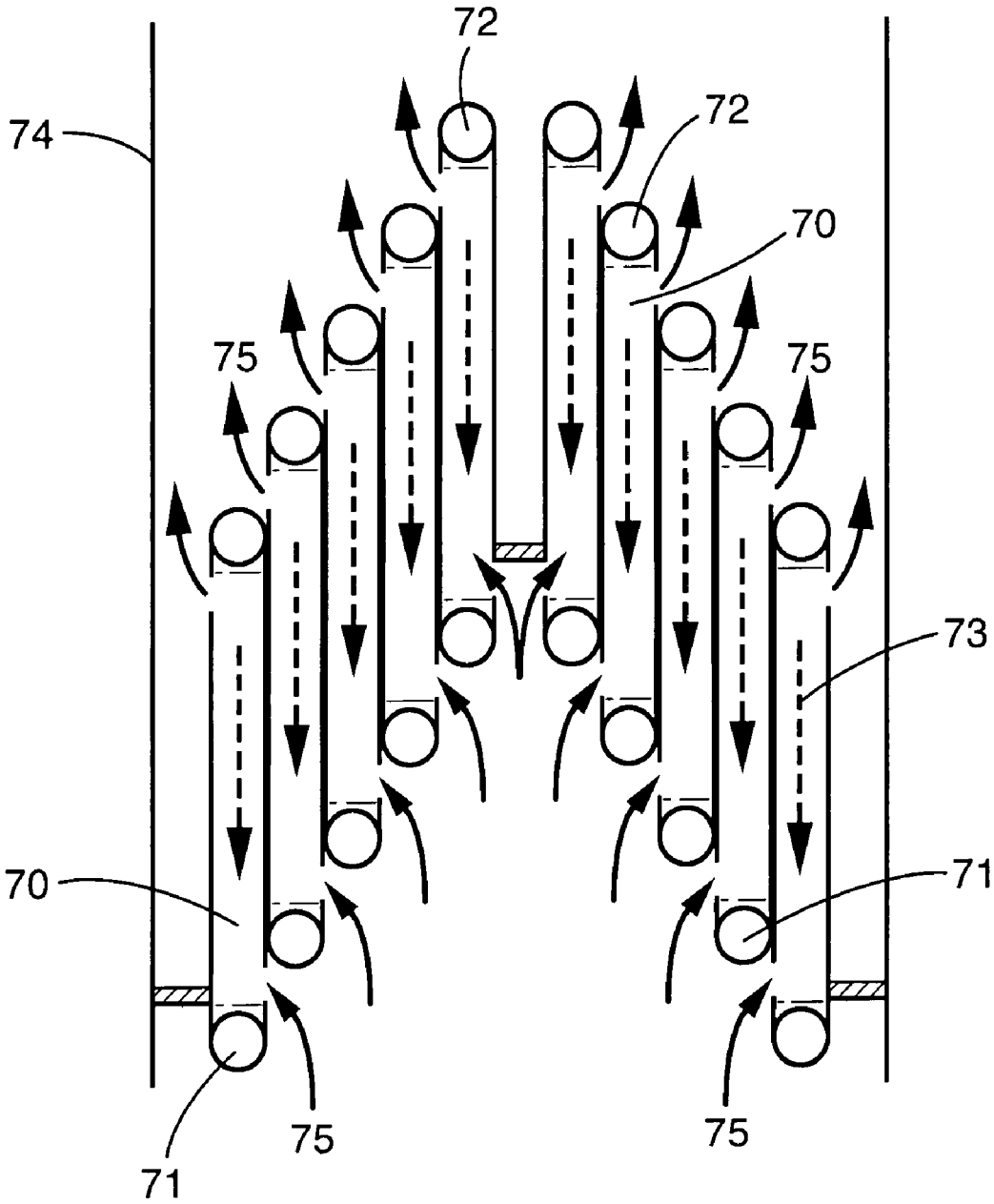

To further improve flow rates and capacity it will be understood that generally in accordance with the present invention a heat exchanger arrangement can be provided formed from clusters of heat exchanger matrixes as described above. Thus, as depicted in FIG. 7 respective counter flow heat exchanger modules 70 can be provided with manifolds 71, 72 joined by tube groups 1, 2 (FIG. 1) through which one fluid flow 73 can pass in counter flow with a second fluid flow 75 passing through the overall exchanger arrangement 74 in order to achieve heat exchange.

It will be understood that heat exchangers and heat exchange arrangements in accordance with the present invention can be utilised within gas turbine engines for intercooling or exhaust heat recuperation but also could act as oil coolers or turbine coolant coolers or other heat exchangers in a multitude of applications and environments.

As indicated above circular and rounded tubes have particular advantages in respect to achieving relatively high pressure operation for the weight and size of tube used. Nevertheless, it will also be understood that other cross sectional shaped tubes may be used where required.

Separation is provided between the fluid flows within the tubes and external to the tubes. By appropriate choice of the interstitial gaps between the tubes and the cross over angle of the tubes, interaction and guiding of the respective fluid flows is achieved with limited impingement upon and restriction to fluid flow such that a relatively high level of heat exchange is provided. The present heat exchanger combines the benefits of a cross-corrugated plate heat exchanger in terms of flow patterns around the tubes with the advantages of a tubular construction for high fluid pressures within the tubes.

As indicated above a heat exchanger will typically comprise a number of heat exchanger elements formed from tubes arranged in stack layers comprising tube groups joined by fluid connecting junctions which act to guide the fluid within the tubes between the respective tube groups as well as typically acting as guide obstructions to external fluid flows about the stack layers that form the heat exchanger matrix. A multitude of such stacks can be formed with relatively high densities of tubes within a defined space envelope to again increase the relative surface heat exchange area available.

The invention claimed is:

1. A gas turbine engine heat exchanger comprising:

a lattice formed from a plurality of tubes, the tubes in the lattice are divided into at least two tube groups, the tubes in at least one tube group are arranged at a crossing angle to the tubes in at least one other tube group and the tube groups are stacked in a stack layer with junctions being defined where a respective tube in at least one tube group crosses a respective tube in at least one other tube group, the lattice having interconnecting interstices between the tubes located at ends of the tube groups to enable heat exchange between a fluid or fluids inside the tubes and another fluid outside the tubes and the junctions being located between the ends of the tube groups, the exchanger being constructed so that the fluid flowing through the tubes is from a gas turbine engine during use, wherein at least some of the junctions provide fluid interconnection between the tube groups.

2. The gas turbine engine heat exchanger according to claim 1 wherein the tubes are circular in cross-section.

3. The gas turbine engine heat exchanger according to claim 1 wherein the interconnecting interstices define channels between adjacent tubes, the channels are obstructed by an obstruction portion of a tube.

4. The gas turbine engine heat exchanger according to claim 3 wherein the obstruction portion of a tube is the junction between the tubes.

5. The gas turbine engine heat exchanger according to claim 3 wherein the obstruction portion of a tube guides fluid flow.

6. The gas turbine engine heat exchanger according to claim 3 wherein the obstruction portion of a tube guides fluid flow between the stack layers of tubes in respective tube groups.

7. The gas turbine engine heat exchanger according to claim 1 wherein the crossing angle between the tube groups within a stack layer and the crossing angle between tube groups in adjacent stack layers is in the range 30° to 60°.

8. The gas turbine engine heat exchanger according to claim 1 wherein the crossing angle between the tube groups within a stack layer and the crossing angle between tube groups in adjacent stack layers is in the range 60° to 120°.

9. The gas turbine engine heat exchanger according to claim 1 wherein tubes in at least two tube groups within the stack layers are arranged to contact with each other to restrain relative movement of the tubes.

10. The gas turbine engine heat exchanger according to claim 1 wherein the tubes in adjacent stack layers are arranged to contact each other to restrain vibration of the tubes.

11. The gas turbine engine heat exchanger according to claim 1 wherein the junctions between the tubes are crossing junctions of the tubes.

12. The gas turbine engine heat exchanger according to claim 1 wherein the junctions between the tubes are end junctions of the tubes.

13. The gas turbine engine heat exchanger according to claim 1 wherein at least some of the tubes are physically joined at, at least some of the junctions of the tubes.

14. The gas turbine engine heat exchanger according to claim 1 wherein fluid interconnection between the tube groups is provided by interconnecting holes, the tubes being welded together about a periphery junction of the interconnecting holes.

15. The gas turbine engine heat exchanger according to claim 1 wherein at least two tube groups with interconnecting junctions are formed as an integral part by electro deposition.

16. The gas turbine engine heat exchanger according to claim 1 wherein the tubes have a surface treatment to facilitate heat exchange.

17. The gas turbine engine heat exchanger according to claim 16 wherein the surface treatment is one of the group comprising dimpled and spiral fluted.

18. The gas turbine engine heat exchanger according to claim 16 wherein the surface treatment and an external surface treatment with respect to the tube surfaces.

19. The gas turbine engine heat exchanger according to claim 1 wherein the tube groups are secured together by edge connectors between the respective tubes in each stack layer.

20. The gas turbine heat engine exchanger according to claim 19 wherein the edge connectors comprise loops to facilitate low flow resistance.

21. The gas turbine engine heat exchanger according to claim 1 wherein the stack layers are identical repeating elements.

22. The gas turbine engine heat exchanger according to claim 1 wherein adjacent stack layers are substantially mirror images about an interface plane between adjacent stack layers.

23. The gas turbine engine heat exchanger according to claim 1 wherein the gas turbine heat exchanger is one of the group comprising a recuperator, an intercooler, an oil cooler, a turbine coolant cooler and a liquid to liquid heat exchanger.

24. A gas turbine engine heat exchanger system comprising a plurality of gas turbine engine heat exchangers according to claim 1.

25. The gas turbine engine heat exchanger system according to claim 24 wherein the (gas turbine heat exchanger system is arranged such that the plurality of heat exchangers are connected together to form a cluster for higher fluid flow rate capacity.

* * * * *